US006186826B1

(12) United States Patent
Weikle

(10) Patent No.: US 6,186,826 B1
(45) Date of Patent: Feb. 13, 2001

(54) FILTER AND JACK MOUNTING HOUSING

(75) Inventor: Owen B. Weikle, Hutchinson, MN (US)

(73) Assignee: Communications Systems, Inc., Hector, MN (US)

( * ) Notice: Under 35 U.S.C. 154(b), the term of this patent shall be extended for 0 days.

(21) Appl. No.: 09/489,174

(22) Filed: Jan. 21, 2000

(51) Int. Cl.[7] ..... H01R 13/60
(52) U.S. Cl. ..... 439/536; 439/76.1; 439/545
(58) Field of Search ..... 439/533, 535, 439/536, 545

(56) References Cited

U.S. PATENT DOCUMENTS 4,369,340 * 1/1983 Beatenbough ..... 439/536
4,411,485 10/1983 Wiseheart et al. ..... 439/536
5,008,931 * 4/1991 Siemon et al. ..... 379/399
5,290,175 * 3/1994 Robinson et al. ..... 439/540
5,356,310 * 10/1994 Garthwaite et al. ..... 439/535
6,056,593 * 5/2000 Strang et al. ..... 439/536

* cited by examiner

*Primary Examiner*—T. C. Patel
(74) *Attorney, Agent, or Firm*—Westman, Champlin & Kelly, P.A.

(57) ABSTRACT

A communication line adapter assembly is used for converting an existing wall phone mounting plate into a filtered outlet jack for use with DSL lines. The adapter has a housing that fits over the existing studs of a wall plate for a wall phone, and has a spring loaded latch which latches the assembly in position when the adapter housing is mounted over the existing studs. The latch holds the head of a stud from being removed by preventing sliding of the stud along the mounting slots in the direction for release. A filter is carried on the adapter housing, and a cover plate that replicates the positioning of the telephone wall mounting studs is mounted over the adapter housing.

9 Claims, 5 Drawing Sheets

FILTER AND JACK MOUNTING HOUSING

BACKGROUND OF THE INVENTION

The present invention relates to a wall mounted line conditioner for digital subscriber lines (DSL lines) used for voice and internet communications that is integrated into a quickly attached bracket that mounts onto studs on an existing wall phone bracket and is latched in place without tools and without using screw terminals.

The advent of high speed internet connections along existing telephone lines, where both voice communication and digital communication take place, has resulted in the need for filters that will block impedance interferences at high frequencies. The need for the filters has resulted in unsightly external filters, or filters that form part of a permanent connector wall jack bracket for a wall jack and require installation of the new jack bracket using screw terminals after removal of the existing bracket.

In many instances, wall telephones are mounted onto wall plates that have standoff studs that hold a telephone body plugged directly into a center jack. The present invention permits the installation of the line conditioner filter to a wall telephone plate and jack, with external mounting studs that will receive the wall telephone, without any hard wiring of terminals and without any unsightly filters protruding or hanging from existing wall jacks.

SUMMARY OF THE INVENTION

The present invention relates to a quickly installed DSL filter circuit and wall plate assembly that will clip onto existing wall telephone wall plates, and which houses the line conditioner circuits for DSL lines. The jack mounting bracket of the present invention has a quickly attachable base plate that fits onto the existing standoff studs used for mounting wall telephones onto existing wall telephone plates, and latches in place to prevent the jack mounting bracket of the present invention from being removed accidentally. The outer surface of the jack mounting bracket of the present invention replicates the wall plate used for mounting wall telephones, so that the wall telephone can be installed on the new bracket, and will connect with the existing telephone line through the filter, for use with DSL lines.

The jack mounting bracket of the present invention is easily installed and greatly simplifies the attachments of filters that are used for satisfactory DSL digital and voice communications.

The construction includes a housing with a back plate that will mount onto the existing wall telephone standoff studs, and an intermediate circuit board for the filter components. A modular plug carried by the housing is installed into the existing wall telephone jack. A jack is provided on the external or outer cover plate of the housing. Since the outer cover plate replicates the existing wall telephone mounting plate a wall telephone can be placed into position easily and the entire installation process is very rapid.

DETAILED DESCRIPTION OF THE ILLUSTRATIVE EMBODIMENTS

The line conditioner or filter and modular jack assembly illustrated generally at 10 as shown, has a pair of standoff mounting studs 12, 12 that are spaced apart a standard distance for mounting a wall telephone (not shown). The studs each include a shank portion and a head. A communication line jack 14 is mounted in a central opening in a front wall 16 of a cover plate 80, and when a wall telephone is installed, it is mounted onto the studs 12, 12 with a modular plug on the wall telephone inserted into and connected in the jack 14.

Figure 1:
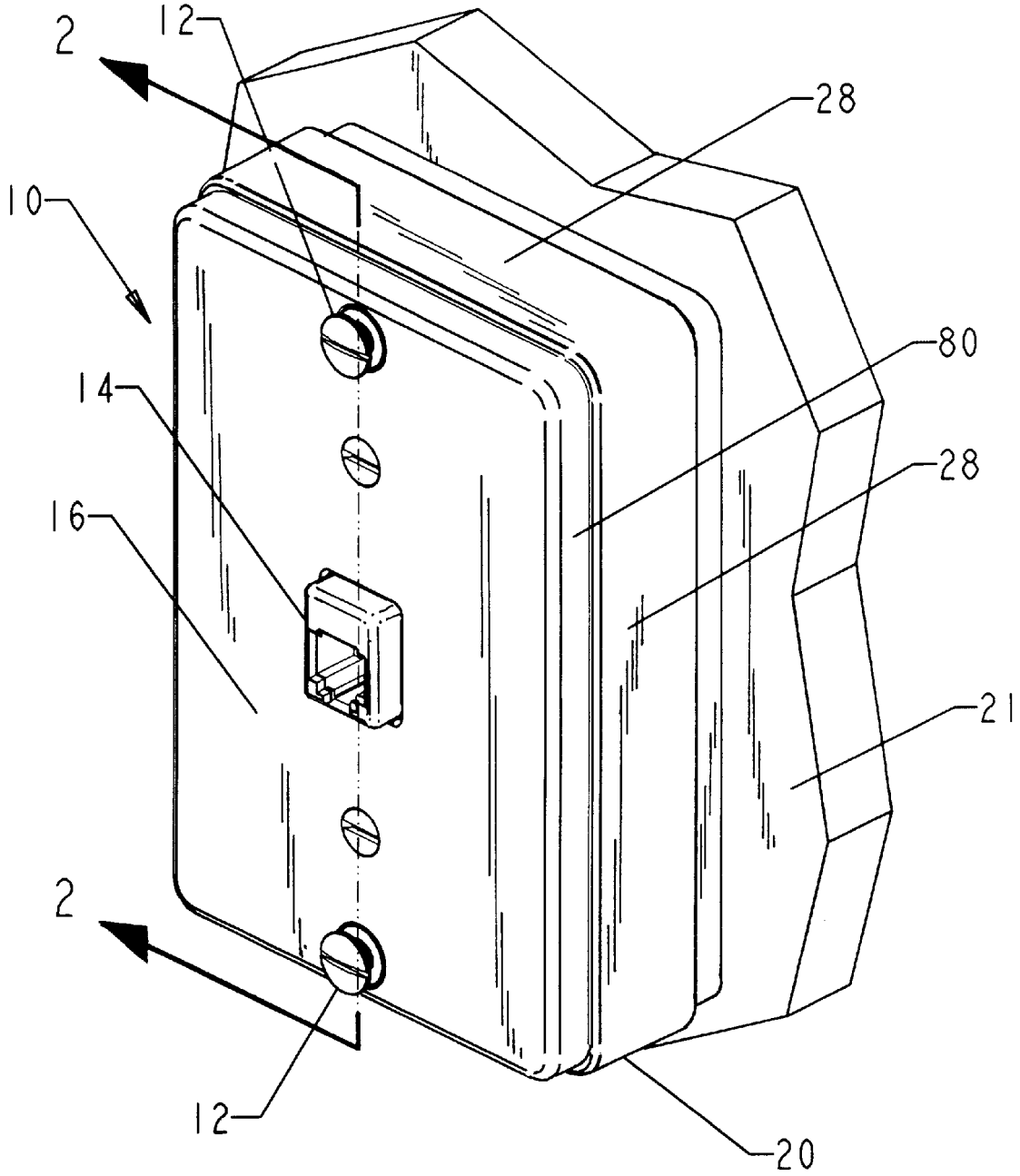
FIG. 1 is a front perspective view of a filter and wall telephone jack mounting housing made according to the present invention.
Figure 2:
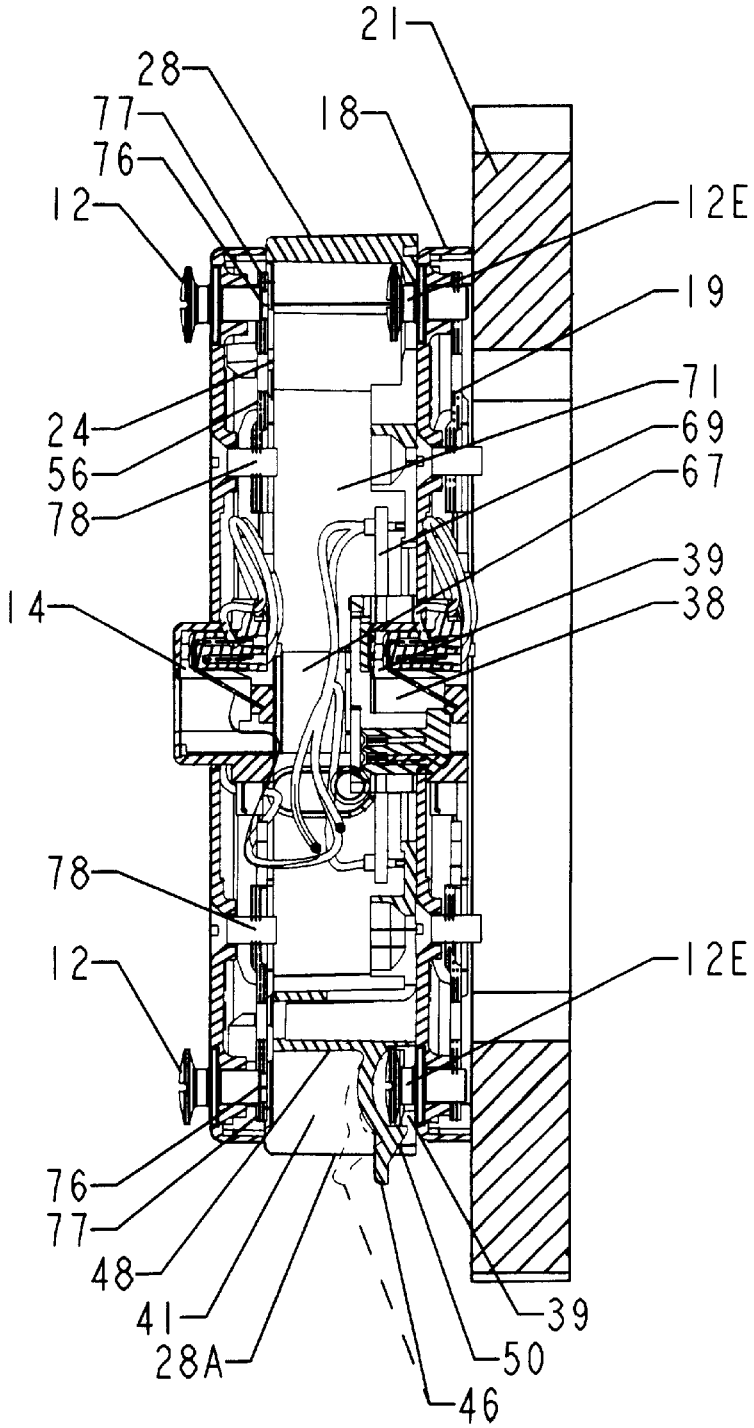
FIG. 2 is a sectional view taken on line 2–2 in FIG. 1.

The view of FIG. 2 shows the assembly on an existing mounted wall telephone wall plate assembly 18, having a metal mounting plate 19 secured in a box on a wall 21. The existing wall telephone mounting plate is shown in U.S. Pat. No. 4,411,485. The mounting plate 19 supports stand-off studs 12A. It also mounts a wall telephone modular jack 23.

Figure 3:
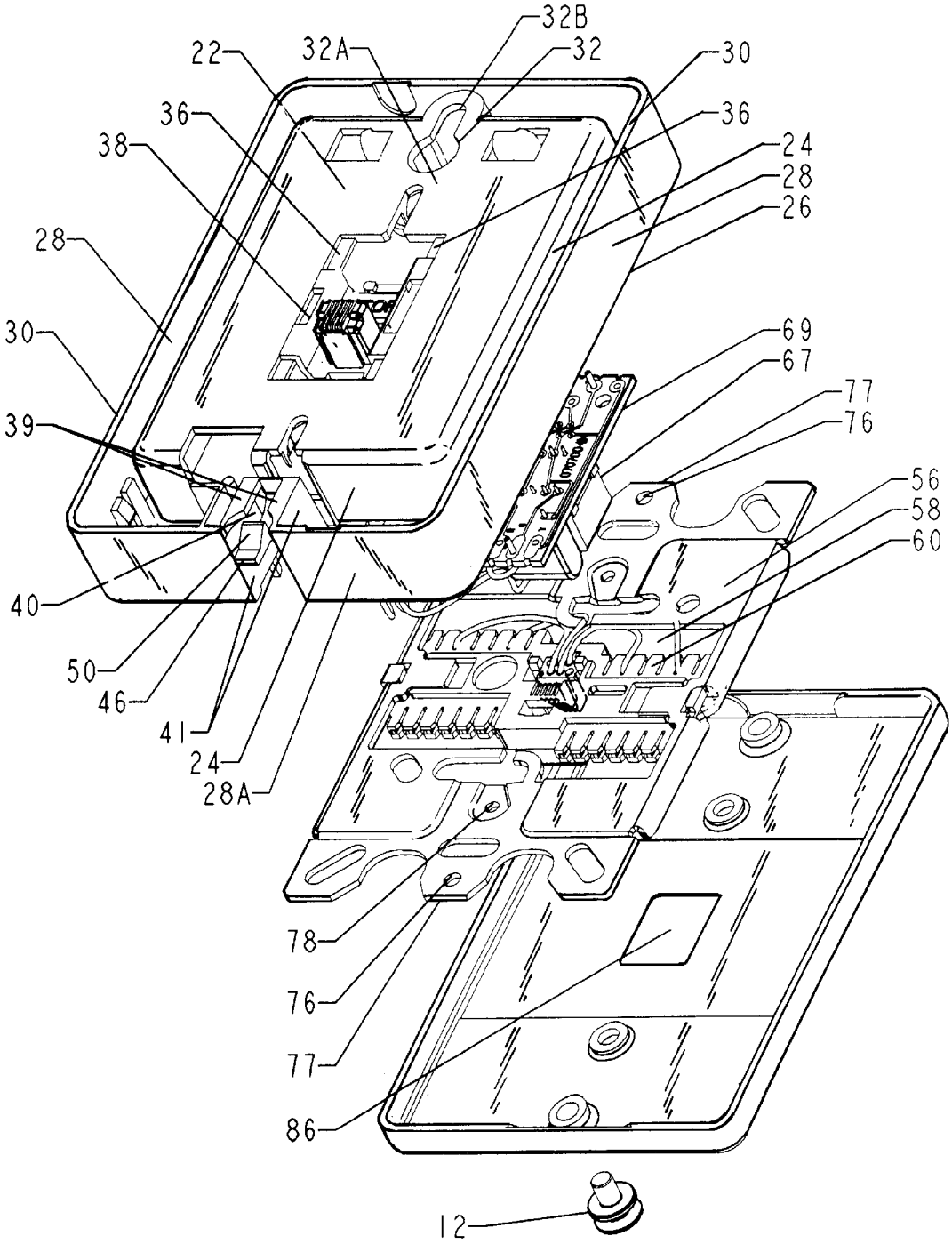
FIG. 3 is an exploded view of the jack mounting housing taken from the back side showing the component separated, with the rear mounting housing at the top.

The line filter and modular jack assembly 10 is shown in an exploded view in FIG. 3.

An adapter housing 20 has a mounting wall 22 supported with side and end walls 26 that extend back from a front bounding wall 24. The wall 24 (see FIG. 4) is bound by an edge 26. A peripheral skirt 28 joins the edges 26 and is spaced from and generally parallel to the walls 24, and surrounds the mounting wall 22.

The skirt 28 is made so that its back edge 30 will rest against the existing wall plate when the assembly 10 is mounted on a wall telephone plate. The edge 30 supports the assembly 10 in position.

The mounting wall 22 has a keyhole slot 32 at an upper end thereof, which will be used for mounting onto studs 12E, that are on the existing wall mount telephone plate 18. The mounting wall 22 also has an aperture 34 that is used for mounting a modular plug 38 on side tracks 36, 36. This is a conventional mounting for a modular plug on a wall telephone mounting plate. The modular plug has slides 37 that receive the tracks 36 so that the modular plug can slide along the tracks in a vertical direction when it is installed to accommodate slight variations in the positioning of the existing wall jack 39 (FIG. 2) relative to the mounting studs 12E. The sliding also permits the insertion of the plug 38 into the existing jack 39 in one position, and then permits lifting the entire adapter housing 20 and the other components forming the line filter and modular jack assembly 10 to engage the keyhole slot 32. The large end 32A of the keyhole slot 32 goes over the head of the upper existing stud 12E and then the assembly 10 is slid back down so the slot neck 32B holds the assembly onto the studs 12A.

In one preferred form, the modular plug 38 is not mounted on tracks, but is left unsecured and on an end of a short cable. It can be manipulated and plugged into the existing wall jack and then the adapter housing mounted on the existing studs 12A. The lower end of the adapter housing 20 has a retaining slot 40 formed in a housing portion having side walls 41 and a top cross wall 48. The side walls 41 have in-turned flanges 39 that define the slot 40. There is an enlarged opening 42 that is opens through the bottom skirt portion 28A of the skirt 28 of the adapter housing 20. The flanges 39 are on a plane with edges 30 of the skirt 28. Slot 40 is a partial keyhole slot that will slip over the shank of a lower mounting stud 12E on an existing wall plate as shown in FIG. 2.

Figure 5:
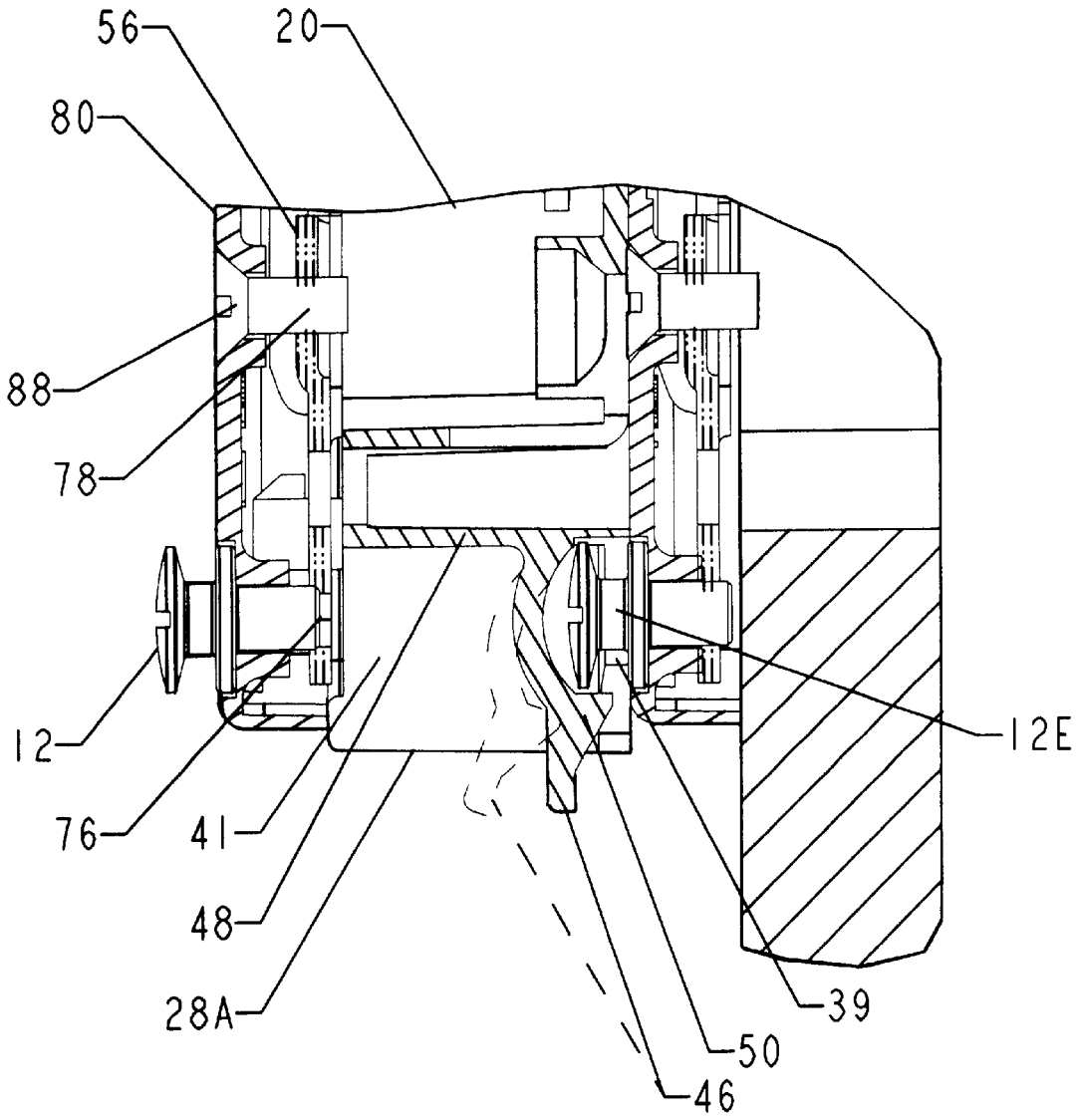
FIG. 5 is an enlarged view of a lower portion of the housing showing a latch tab used with the present invention.

As shown in FIG. 5 the cross wall slot 48 is molded in position on the adapter housing 20 and supported by the side walls 41. The wall 48 supports a depending spring finger latch 46 with a spring finger latch dog 50 formed thereon. The spring finger latch 46 is just to the inside of the flanges 39 and aligned with the slot 40. When the adapter housing 20 and other components forming the assembly 10 is slipped over the existing mounting studs 12E of an existing wall plate, and the upper stud 12E is seated in the keyhole slot 32, so that the narrow neck portion of the keyhole slot 32 is retained behind the head of the upper stud 12E, the spring finger latch 46 will spring load so that the latch dog 50 slips under the head of the lower stud 12E, and will engage the lower side of the heads. The adapter housing 20 then cannot be moved up to release it from the upper keyhole slot 32 unless the spring finger latch is 46 is moved outwardly to permit the dog 50 to clear the head of the lower stud, as shown in dotted lines in FIGS. 2 and 5.

A metal frame mounting plate 56 is formed with a central recess or opening 58 that mounts a molded assembly of insulation displacement connectors 60 that span the opening 58 and are molded to support a modular jack member, such as that shown at 14. The insulation displacement connectors 60 have slot for attaching wires 62G from modular plug 38 which will couple to an outside communication line. The flat insulation displacement connectors can be mounted to the plate 56 in a suitable manner, and held securely in position. Assemblies as shown that include a modular jack with insulation displacement connectors (IDCs) on opposite sides thereof and which attach to locations that are provided on the plate 56 are known.

Figure 4:
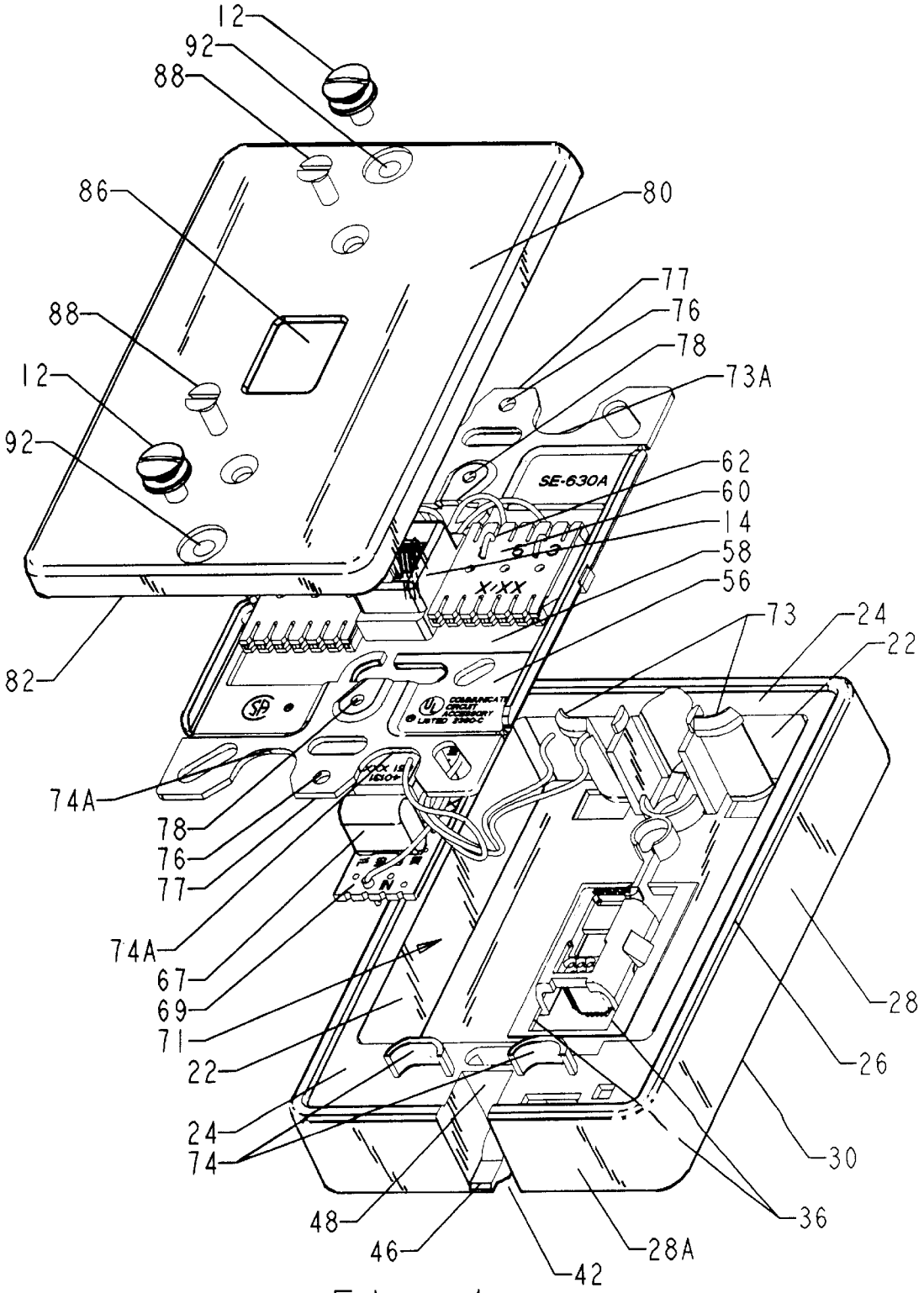
FIG. 4 is an exploded view with parts removed, from the front side.

Any flat mounting plate or frame 56 can be used, as long as it supports suitable connectors for connecting selected incoming wires from modular plug 38 to filter components 67 on a circuit board 69 that is illustrated only schematically in FIGS. 2, 3 and 4.

The circuit board components 67 are connected with wires having length so the board 69 and components 67 thereon can be manipulated to position in a recess 71 of housing 20, as shown in dotted lines in FIG. 4.

The recess 71, as shown in FIG. 4, in which the circuit board 69 and the components thereon are stored is formed by walls 26. The output lines from the filter components on board 69, and other needed lines, are connected to the modular jack 14 from the input modular plug 38.

The plate 56 is a metal support plate, that securely mounts the IDCs. The plate 56 can be snapped in place on housing 20 using molded in guide posts 74 at one end, and spring clips 73 at the other end. The posts have shoulders which receive the edges of recessed portions 73A and 74A on the plate 56.

The plate 56 carries modular jack 14 so that it is protruding from the surface of the plate. The plate 56 also serves as the frame for mounting the studs for the wall phone, and has threaded openings 76 formed on ears 77, as well as threaded openings 78 which will be used for mounting a cover plate. The threaded opening 76 are used for the attachment of the posts 12 that correspond in position to post 12E.

The plate 56 is held in place on the housing 20 with the posts 74 and spring clips 73. The circuit board 69 is behind plate 56 in chamber or recess 71. The insulation displacement connector boards can be insulated from the other component with a suitable insulation layer overlying the connections so the wires do not short out.

A cover plate 80 is included and replicates the existing cover plate for a wall phone. The cover plate 80, as shown, has a flange 82 of suitable size to fit in a provided groove along edge 26 of the adapter housing 20, so that the mounting frame 56 is covered with the cover plate 80. The cover plate 80 has a central opening 86 through which communication jack 14 protrudes. The jack 14 extends through the front surface of the cover plate 80 and is available for use with a wall phone. The cover plate 80 is secured to frame plate 56 that covers the circuit board, with screws 88 which pass through provided apertures and thread into openings 78 in the mounting plate 56. The mounting studs 12 pass through apertures 92 in the cover plate.

Recesses surround the apertures for receiving a flange on the studs. The studs 12 are threaded into the threaded openings 76 of the frame plate 56. The studs 12 are spaced at the same spacing as the studs 12E on the existing wall phone cover plate, and are used for mounting a wall phone in a desired position. The adapter housing 20 is placed into position on the existing studs 12E and held with latch finger 39.

The circuit board 69 is held within the chamber 71 formed in the adapter housing 20. The filter and the mounting parts can be preassembled so the unit does not require independent hard wiring. The assembly 10 can be quickly and easily installed onto the existing cover plates for a wall phone. The spring finger latch 39 securely holds the assembly 10 in position on the existing mounting studs 12E, but it can be released merely by moving the lower edge resiliently to the dotted line position for example, as shown in FIG. 5, so that the adapter housing wall 22 can be slid upwardly and released from the studs 12E on the existing cover plate.

Although the present invention has been described with reference to preferred embodiments, workers skilled in the art will recognize that changes may be made in form and detail without departing from the spirit and scope of the invention.

What is claimed is:

1. An adapter for mounting onto existing studs on a wall cover plate for a communication jack comprising a housing having a mounting wall, the mounting wall having a first keyhole slot adjacent one end thereof, and a second open ended slot formed at a second end of the wall, the keyhole slot and second slot being aligned and spaced a selected distance apart, and a spring finger latch aligned with the second slot and having a latch dog extending toward the slot, the latch dog having a shoulder facing toward the keyhole slot.

2. The adapter of claim 1 wherein said spring finger latch is an integrally molded with the housing.

3. The adapter of claim 1, wherein the housing defines a recess with the mounting wall forming a wall of the recess, a frame plate supported on the housing spaced from the mounting wall, a communication line input connector and a communication line output connector, a filter circuit board connected between the input and output connectors, the recess being of size to receive the filter circuit board.

4. The adapter of claim 3, and a cover plate overlying the frame plate, said frame plate having threaded openings for telephone mounting studs that pass through the cover plate.

5. The adapter of claim 1, wherein the housing has a frame plate thereon, a communication jack mounted on the frame plate, a communication plug on the mounting wall for coupling to an external communication line, a filter circuit carried in the housing and coupled between the plug and the jack, the jack being connected to the circuit board and protruding from the housing.

6. A filter and jack mounting bracket comprising an adapter housing having a wall that is generally planar and which has a keyhole slot at one end thereof, and a open ended slot at an opposite end thereof, said housing having a recess for receiving a circuit board, and a cover plate supported relative to the housing, said cover plate having a pair of studs extending therefrom that are positioned and spaced to support a wall telephone, and a latch associated with the open ended slot for latching a stud positioned in the open ended slot to prevent removal of the stud from the open ended slot.

7. The assembly of claim 6 and a modular plug carried by the housing, a modular jack mounted on the housing to extend out from the cover plate, a filter carried in the housing, the filter being connected to wires from the modular plug and being connected to the modular jack.

8. The assembly of claim 7, wherein said modular plug is slidably mounted in an aperture on a rear wall of the housing.

9. The assembly of claim 1, further comprising a frame plate, the modular jack being mounted on the frame plate and protruding through an aperture in the cover plate and positioned at a known location between the studs of the cover plate.

* * * * *